United States Patent [19]

Güttinger et al.

[11] 4,334,468

[45] Jun. 15, 1982

[54] DOUBLE BELT PRESS

[75] Inventors: Manfred Güttinger, Stuttgart; Konrad Schermutzki, Remseck, both of Fed. Rep. of Germany

[73] Assignee: Sandvik Conveyor GmbH, Fellbach, Fed. Rep. of Germany

[21] Appl. No.: 143,518

[22] Filed: Apr. 24, 1980

[30] Foreign Application Priority Data

May 31, 1979 [DE] Fed. Rep. of Germany ..... 2922151

[51] Int. Cl.[3] ..... B30B 5/06

[52] U.S. Cl. ..... 100/93 RP; 100/153; 156/583.5; 425/371

[58] Field of Search ..... 100/93 RP, 118, 153, 100/154; 156/583.5; 425/370, 371, 372, 384; 165/120; 62/380, 374, 63

[56] References Cited

U.S. PATENT DOCUMENTS

| | | | |
|---|---|---|---|
| 2,075,735 | 3/1937 | Loomis | 425/371 X |
| 2,286,514 | 6/1942 | Stebbins | 62/380 X |
| 2,720,231 | 10/1955 | Hessler et al. | 100/154 |
| 3,223,027 | 12/1965 | Shigenari et al. | 100/154 X |
| 3,461,021 | 8/1969 | Brinkmeier et al. | 100/93 P |
| 3,773,876 | 11/1973 | Rath et al. . | |
| 4,186,797 | 2/1980 | Guttinger | 100/154 |

FOREIGN PATENT DOCUMENTS

| | | | |
|---|---|---|---|
| 920934 | 2/1973 | Canada | 156/583.5 |
| 2729559 | 9/1978 | Fed. Rep. of Germany . | |

*Primary Examiner*—Peter Feldman

*Attorney, Agent, or Firm*—Burns, Doane, Swecker & Mathis

[57] ABSTRACT

A double belt press comprises two endless steel belts revolving in opposing directions with mutually facing sides thereof pressed against each other and against material passed therebetween by means of stationary, temperature-controlled press plates. The belts are guided by revolving roller chains on the press plates which are speed-coordinated with the roller chains. A heat transfer mechanism is provided along the path of travel of the roller chain of at least one press plate in order to change the temperature of the roll elements of the roller chains.

6 Claims, 2 Drawing Figures

DOUBLE BELT PRESS

BACKGROUND AND OBJECTS OF THE INVENTION

The invention concerns a double belt press, comprising two continuous steel belts revolving in directions opposite to each other. Mutually facing sides of the belts are pressed against each other and against material conducted therebetween, by means of temperature controlled press plates. The belts are guided along the press plates by means of roller chains which are speed-coordinated with the press plates.

Double presses of this type are known (see German AS No. 27 29 559). In those known designs, heated press plates are usually provided so that, for example in the continuous production of pressboard plates, not only the necessary pressure, but also the required temperature may be applied. The necessary transfer of heat from the press plates to the steel belts and from there to the material to be treated is effected by rolls revolving between the press plates and the steel belts and guided on the roller chains.

It is also known to provide different zones of treatment of the above-mentioned type in double belt presses so that for example, certain zones may be at different temperatures. There are, however, certain production processes where it is desirable not only to provide zones with different temperature ranges in sequence, but wherein it is necessary to effect subsequent manufacturing steps whereby sudden rises or drops in temperature are required. Such changes in temperature are not feasible with the known designs of double belt presses. It is hindered essentially by the mass of the revolving roller chains which is very large compared with the mass of the revolving steel belts and the thin layer of material in between. The individual roll links of the roller chains do transfer the requisite amount of heat to the material from the press plates or inversely from the material to the plates, but because of the temperature inertia created by their large mass, they are unable to effect sudden steep variances in temperature.

Installations have been proposed wherein a substantial amount of heat may be removed from the material very rapidly for example by means of an intensive spray cooling of the rear side of the revolving steel belts. Such heat transfer means, acting possibly in both directions, prevent, however, the application of high pressures, because the revolving steel belts must be necessarily guided on pressure elements, which with existing materials cannot be rendered sufficiently frictionless to permit their practical use without the insertion of roller chains.

It is, therefore, an object of the invention to provide a double belt press which enables the material to be treated to be exposed both to high pressures and to large, abrupt changes in temperature.

SUMMARY OF THE INVENTION

The invention involves providing, in the path of revolution of the roller chains of at least one of the pressure plates, certain heating and/or cooling devices to affect the temperature of the rolls. This design makes it possible to transfer to, or remove from, the rolls sufficient heat so that they themselves may act as heat transfer elements with respect to the steel belt, so that the disadvantages associated with inertia during the transfer of heat is minimized. Because the mass of the rolls compared with that of the steel belts and the material to be treated is approximately seven times larger, a substantial proportion of heat may also be transferred to, or removed from, the material independently of the press plates. The installation according to the invention thus makes it possible to effect abrupt changes in the temperature of the material during its passage through the double belt press. It has been found, for example, that shock-like cooling processes within a range of temperatures around the freezing point may be achieved without difficulty.

It is advantageous to locate the heating and/or cooling devices in the area of the returning side of the roller chains, at a point as close to the contact area of the rolls with the belts as possible. If adequate thermal insulation is provided, the entire heat capacity transferred to or removed from the rolls by the supplemental heating and/or cooling devices may be imparted to the steel belts and from there to the material to be treated.

The heating and/or cooling devices may comprise a chamber through which a temperature controlled flow of air is passed with the rolls being guided through such chamber. The devices may, however, also comprise spray nozzles which apply a spray of heated or evaporating liquids to the rolls. This last possibility has the advantage that, for example, highly intensive cooling is feasible. In order to prevent the presence of residual liquid on the rolls, it is appropriate to insert a drying chamber operated with a heated flow of air subsequently to the spraying device.

THE DRAWING

The invention is illustrated by means of an example of embodiment in the drawing and explained in the description to follow hereinafter. In the drawing:

FIG. 1 shows a schematic longitudinal section through a double belt press according to the invention; and FIG. 2 is an enlarged representation of a part of the double belt press of FIG. 1.

DETAILED DESCRIPTION OF A PREFERRED EMBODIMENT OF THE INVENTION

Figure 1:
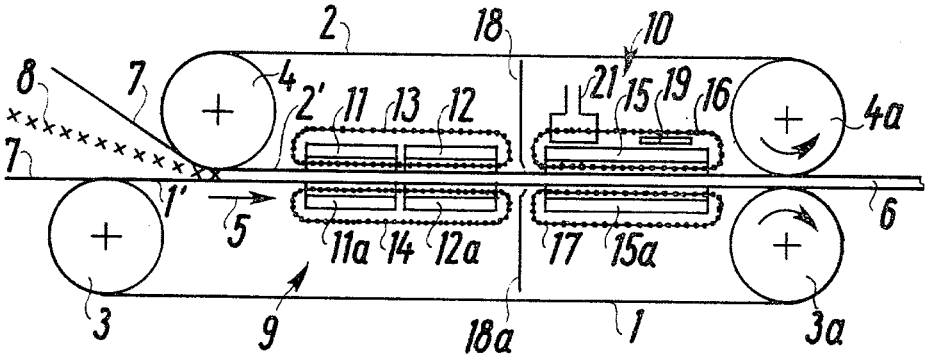

FIG. 1 shows two continuous rotating steel belts 1 and 2 arranged in superimposed relationship, one above the other, and guided by associated idler rolls 3 and 4, and by driven rolls 3*a* and 4*a*. The power drive is effected synchronously in a known manner, so that the mutually facing sides 1' and 2' of the belts travel at the same velocity in the direction of the arrow 5 and form a gap or nip therebetween capable of accepting, in a known manner, the material 6 to be treated. Such material may comprise, for example, two thermoplastic sheets 7 with a reinforcing layer 8 between them. The two foils 7 and the reinforcing insert 8 are unwound by feed rolls, not shown, and enter the gap between the two steel belts 1 and 2, where they are joined together under the effect of pressure and temperature.

Different treating zones or assemblies are typically provided within the revolving steel belts 1 and 2, two of which, i.e., those of zone 9 and zone 10, are shown. Obviously, more than two of those zones may be provided.

Within the upstream zone 9, press plates 11, 12, 11*a* and 12*a* are associated in a known manner with each steel belt 1 and 2, respectively. The pairs of press plates 11 and 11*a* are pressed against each other in a manner not shown in detail, so that the sides 1' and 2' of the steel bands located between them are pressed against the material 6. The press plates 11 and 11*a* may be heated so that the material is also heated within this region. The press plates 12 and 12*a* are pressed against each other in a similar manner and may also be heated, so that in this region the material is heated to a temperature that may be higher or lower than in the region of the press plates 11 and 11*a*.

In order to prevent friction between the sides 1' and 2' of the steel belts against the press plates 11 and 12, and 11*a* and 12*a*, respectively, revolving roller chains 13 and 14 are provided. The chains move with the belts and effect a low friction guidance of the belts on the press plates, even when the latter are applying high pressure to the chains.

Figure 2:
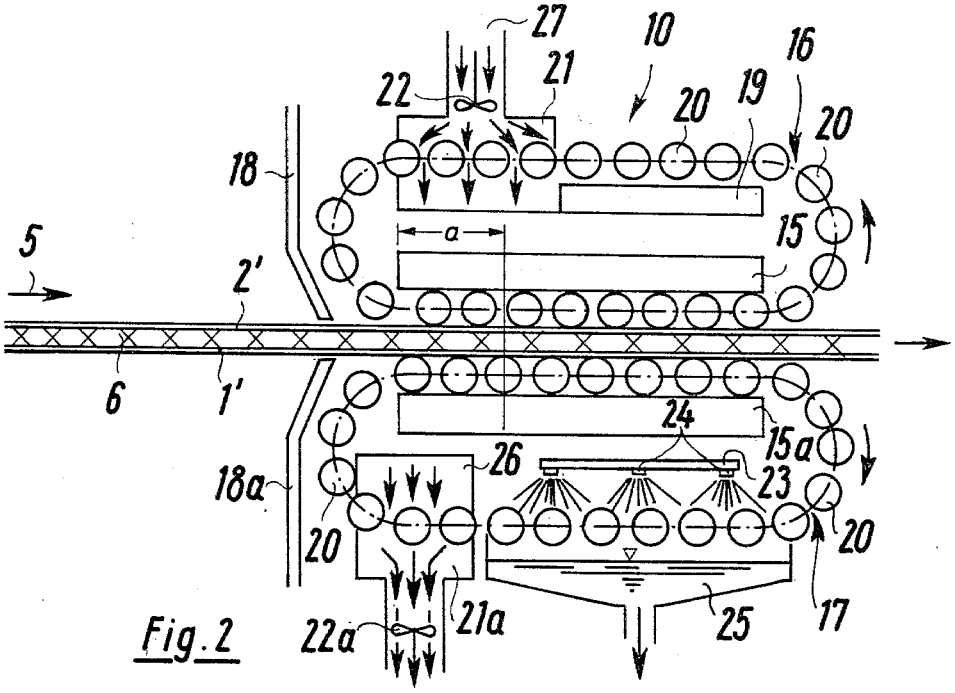

The same arrangement is provided in principle in the zone 10, except that here, as shown in FIG. 2, two press plates 15 and 15*a* are pressed against each other and are intended to perform a cooling function. The press plates 15 and 15*a*, respectively, are surrounded by revolving roller chains 16 and 17, respectively, which roller chains provide frictionless guidance of the two sides 1' and 2' on the press plates 15 and 15*a*, similar to the chains 13, 14.

As seen in particular in FIG. 2, the zone 10 is separated by insulating walls 18 and 18*a* from the rest of the zones, so that in the zone 10, the material 6 may be exposed to temperature effects different from those of the preceeding zone 9, for example, intensive cooling in contrast to the heat preceeding it. In order to effect such a cooling abruptly and in the manner of a shock, there is provided at the returning side of the upper roller chain 16 (i.e., in the area not located between the press plate 15 and the side 2' of the steel belt 2) an additional heat transfer device, i.e., a temperature controlled plate 19. The returning individual rolls 20 of the chain 16 are guided over the plate 19 and have their temperature controlled by means of heat conduction through contact with the plate 19.

In the preferred embodiment, the plate 19 comprises a cooling plate and functions to cool the returning rolls 20. In addition, a heat transfer chamber 21 is provided at the returning side of the chain 16, through which the returning rolls 20 are passed. In the chamber 21 a flow of air, for example cooling air, is maintained with the aid of a blower 22 or the like which, by means of forced convection, augments the cooling of the individual rolls 20 of the roller chains 16.

In practice, the layout and extent of heat conduction is chosen so that the roller chains 20 in the area a of a working side of the chain, located at the beginning of the press and cooling plate 15 in the direction of travel 5, are at a desired temperature adapted to the process requirements, so that they may apply their cooling capacity to the material 6 coming from the preceeding zone 9 (and still in the heated condition) by way of the sides 1' and 2' of the steel belts 1, 2. It is thus possible to effect intensive cooling in this area. Obviously, it is also possible to achieve intensive heating, instead of cooling, by suitably heating the plate 19 and the flow of air in the chamber 21.

Along the return side of the lower roller chain 17 which cooperates with the lower steel belt 1 and the press plate 15*a*, there are provided heat transfer devices to effect temperature control of the rolls 20. Thus, a spraying device 23 is provided, the spray nozzles 24 whereof may be used to apply, for example, a cooling solution or a rapidly evaporating liquid, for example a cryogenic liquid, such as liquid nitrogen or fluorochloromethane, to the rolls. That liquid is collected in a collector vessel 25 (if a nonevaporating fluid is involved) and returned to the spray device 23.

It is also possible to spray a hot liquid or steam onto the rolls 20 (which steam being condensed and collected in the vessel 25) when it is desired to heat the rolls 20.

In a manner similar to the chamber 21, a chamber 21*a* is arranged along the lower roller chain 17, which chamber 21*a* is provided with a blower 22*a*. In this case, the direction of the flow through the chamber 21*a* relative to the rolls 20 is changed from that of chamber 21, because the air coming from the chamber 21 is conducted out laterally from the revolving belt 2, reheated (or cooled) and then passed into the area 26 of the chamber 21*a* and, with the aid of the blower 22*a*, re-circulated to the chamber 21. A heating (or cooling) device may be inserted in front of the suction fitting 27 of the chamber 21 to re-heat (or re-cool) the air.

The arrangement according to the present invention makes it possible to rapidly effective intensive cooling or heating with double belt processes, wherein the relatively high heat capacity of the revolving steel rolls may be utilized to affect the temperature of the material 6.

Although the invention has been described in connection with a preferred embodiment thereof, it will be appreciated by those skilled in the art, that additions modifications, deletions and substitutions may be made, without departing from the spirit or scope of the invention as described in the appended claims.

What is claimed is:

1. A double belt press comprising:
   - a pair of endless steel belts revolving in opposite directions with mutually facing sides thereof forming a nip through which material is to be passed,
   - a plurality of treating assemblies spaced along said nip for pressing said belts together and controlling the temperature of said belts, each of said assemblies comprising:
     - a pair of temperature-controlled stationary press plates disposed within respective ones of said belts for pressing such belts against material passing through the nip, said press plates including means for controlling the temperature thereof, and
     - a pair of revolving chains traveling around respective ones of said press plates, each chain defining a working side disposed in said nip and a return side, each chain including a plurality of rotating rolls which travel between and in contact with said press plate and said belt to transmit pressing forces and thermal energy from the former to the latter,
   - one of said treating assemblies including heat transfer means arranged to act upon said rolls along said return side and adjacent the entry to said nip for controlling the temperature of said rolls.

2. Double belt press according to claim 1, wherein said heat transfer means comprises a chamber through which a temperature-controlled flow of air is passed, with said rolls being passed through said chamber.

3. Double belt press according to claim 1, wherein said heat transfer means comprises a spraying device spraying a temperature-controlled fluid onto the rolls.

4. Double belt press according to claim 1, further including a temperature-controlled plate over which the rolls are guided along the return side.

5. Double belt press according to claim 1, wherein said heat transfer means heats said rolls.

6. Double belt press according to claim 1, wherein said heat transfer means cools said rolls.

* * * * *